US009505584B2

(12) United States Patent
Faruki et al.

(10) Patent No.: US 9,505,584 B2
(45) Date of Patent: Nov. 29, 2016

(54) ELEVATOR CAR ASSIGNMENT STRATEGY THAT LIMITS A NUMBER OF STOPS PER PASSENGER

(75) Inventors: Tarique Faruki, Avon, CT (US); Jannah A. Stanley, Portland, CT (US); Ashley Chapman, Avon, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 438 days.

(21) Appl. No.: 14/232,621

(22) PCT Filed: Jul. 15, 2011

(86) PCT No.: PCT/US2011/044188

§ 371 (c)(1), (2), (4) Date: Jan. 14, 2014

(87) PCT Pub. No.: WO2013/012410

PCT Pub. Date: Jan. 24, 2013

(65) Prior Publication Data

US 2014/0166409 A1 Jun. 19, 2014

(51) Int. Cl.

*B66B 1/20* (2006.01)
*B66B 1/24* (2006.01)
*B66B 1/18* (2006.01)

(52) U.S. Cl.

CPC . *B66B 1/20* (2013.01); *B66B 1/18* (2013.01); *B66B 1/2458* (2013.01); *B66B 2201/102* (2013.01); *B66B 2201/211* (2013.01);

(Continued)

(58) Field of Classification Search

CPC ..... B66B 1/20; B66B 1/18; B66B 1/2458; B66B 2201/102; B66B 2201/211–2201/213; B66B 2201/216; B66B 2201/40; B66B 2201/405

USPC ..... 187/247, 380–389, 391–393

See application file for complete search history.

(56) References Cited

U.S. PATENT DOCUMENTS 4,037,688 A * 7/1977 Winkler ..... B66B 1/2458 187/387
4,046,227 A * 9/1977 Kirsch ..... B66B 1/2458 187/387

(Continued)

FOREIGN PATENT DOCUMENTS

| | | | |
|---|---|---|---|
| CN | 101492137 | A | 7/2009 |
| JP | 7309539 | A | 11/1995 |
| KR | 10-0295880 | B1 | 7/2001 |

OTHER PUBLICATIONS

Chinese Search Report for CN Application No. 201180072303.9 dated Aug. 28, 2014.

(Continued)

*Primary Examiner* — Anthony Salata
(74) *Attorney, Agent, or Firm* — Carlson, Gaskey & Olds

(57) ABSTRACT

An exemplary method of controlling an elevator system includes determining that a new passenger requests elevator service from a departure floor to a destination floor. Any candidate elevator cars are ranked. A number of stops for each assigned passenger for a ranked candidate elevator car is determined if the new passenger were assigned to that car. A determination is made whether any ranked candidate elevator car is a qualified car that can accept the new passenger and limit a number of stops for each passenger assigned to that car to a desired maximum number of stops. The new passenger is assigned to a qualified car that has a most favorable ranking of any qualified cars.

20 Claims, 2 Drawing Sheets

(52) U.S. Cl.
CPC .... *B66B2201/212* (2013.01); *B66B 2201/213* (2013.01); *B66B 2201/216* (2013.01); *B66B 2201/40* (2013.01); *B66B 2201/405* (2013.01)

(56) References Cited

U.S. PATENT DOCUMENTS

| | | | | |
|---|---|---|---|---|
| 4,058,187 | A | 11/1977 | Jacoby et al. | |
| 4,411,337 | A | 10/1983 | Schroder et al. | |
| 4,708,224 | A | 11/1987 | Schrooder | |
| 5,219,042 | A | 6/1993 | Sattar et al. | |
| 5,243,155 | A | 9/1993 | Sirag et al. | |
| 5,750,946 | A | 5/1998 | Thangavelu | |
| 5,767,462 | A | 6/1998 | Thangavelu | |
| 5,780,789 | A * | 7/1998 | Tsuji | B66B 1/2458 187/380 |
| 6,401,874 | B2 | 6/2002 | Siikonen | |
| 8,151,943 | B2 * | 4/2012 | de Groot | B66B 1/2458 187/382 |
| 8,162,109 | B2 * | 4/2012 | Amano | B66B 1/2458 187/382 |
| 8,172,044 | B2 | 5/2012 | Tokura | |
| 8,286,756 | B2 | 10/2012 | Koba et al. | |
| 8,297,412 | B2 * | 10/2012 | Roberts | B66B 1/2416 187/292 |
| 8,567,569 | B2 | 10/2013 | Suzuki et al. | |
| 8,800,723 | B2 * | 8/2014 | De Jong | B66B 1/2458 187/388 |
| 8,950,555 | B2 * | 2/2015 | Brand | B66B 1/2458 187/382 |
| 8,978,833 | B2 * | 3/2015 | Suzuki | B66B 1/2458 187/382 |
| 2008/0017453 | A1 | 1/2008 | Finschi | |
| 2010/0282544 | A1 | 11/2010 | Koba et al. | |
| 2010/0314202 | A1 | 12/2010 | Roberts et al. | |

OTHER PUBLICATIONS

International Preliminary Report on Patentability for International application No. PCT/US2011/044188 dated Jan. 30, 2014.

International Search Report and Written Opinion of the International Searching Authority for International application No. PCT/US2011/044188 dated Mar. 26, 2012.

* cited by examiner

40

| Landing | Car A | Car B | Car C |
|---|---|---|---|
| 15 | Current Position Going Down | | |
| 14 | Assigned Call Down to Lobby | | |
| 13 | | | |
| 12 | | | Assigned Call Down to Lobby |
| 11 | Assigned Call Down to Lobby | Assigned Destination | |
| 10 | | | Current Position Going Up |
| 9 | | | |
| 8 | | | |
| 7 | | | |
| 6 | | Assigned Call Up to 11 | |
| 5 | Assigned Call Down to Lobby | Assigned Destination | |
| 4 | | | |
| 3 | | Assigned Call Up to 5 | |
| 2 | | | |
| 1 | | Current Position Going Down | |
| Lobby | Assigned Destination | Assigned Call Up to 11 | Assigned Destination |

42 54 70 72 56 46 68 66 58 64 44 60 74 62

52 Passenger Interface

Elevator Controller 50

Fig-2

ELEVATOR CAR ASSIGNMENT STRATEGY THAT LIMITS A NUMBER OF STOPS PER PASSENGER

BACKGROUND

There are a variety of elevator car assignment strategies for accommodating passenger requests for service. Most approaches are based upon minimizing the amount of wait time that a passenger spends in a lobby before the elevator car arrives to allow the passenger to board the elevator car. The amount of time a passenger waits to board an elevator car is typically regarded as an important measure of passenger satisfaction. For example, a passenger typically regards a long wait time for the arrival of an elevator car to be annoying.

Other elevator car assignment strategies focus on performance of the elevator system to minimize the distance that a car travels or the amount of energy required for elevator system operation, for example.

The variety of considerations that have an influence on elevator system operations and elevator passenger satisfaction can present challenges for deciding how to assign elevator cars to provide service to passengers.

SUMMARY

An exemplary method of controlling an elevator system includes determining that a new passenger requests elevator service from a departure floor to a destination floor. Any candidate elevator cars are ranked. A number of stops for each assigned passenger for a ranked candidate elevator car is determined if the new passenger were assigned to that car. A determination is made whether any ranked candidate elevator car is a qualified car that can accept the new passenger and limit a number of stops for each passenger assigned to that car to a desired maximum number of stops. The new passenger is assigned to a qualified car that has a most favorable ranking of any qualified cars.

An exemplary elevator system includes a plurality of elevator cars. A controller is configured to determine when a passenger requests elevator service from a departure floor to a destination floor. The controller ranks any candidate elevator cars of the plurality of cars. The controller is configured to determine the number of stops for each passenger assigned to a ranked candidate elevator car if the new passenger is assigned to that car. The controller is also configured to determine whether any ranked candidate elevator car is a qualified car that can accept the new passenger and limit a number of stops for each passenger assigned to the qualified car to a desired maximum number of stops. The controller assigns the new passenger to a qualified car that has a most favorable ranking of any qualified cars.

The various features and advantages of disclosed examples will become apparent to those skilled in the art from the following detailed description. The drawings that accompany the detailed description can be briefly described as follows.

BRIEF DESCRIPTION OF THE DRAWINGS

FIG. 2 schematically illustrates selected portions of an elevator system including information regarding a current status of the system.

DETAILED DESCRIPTION

Figure 1:
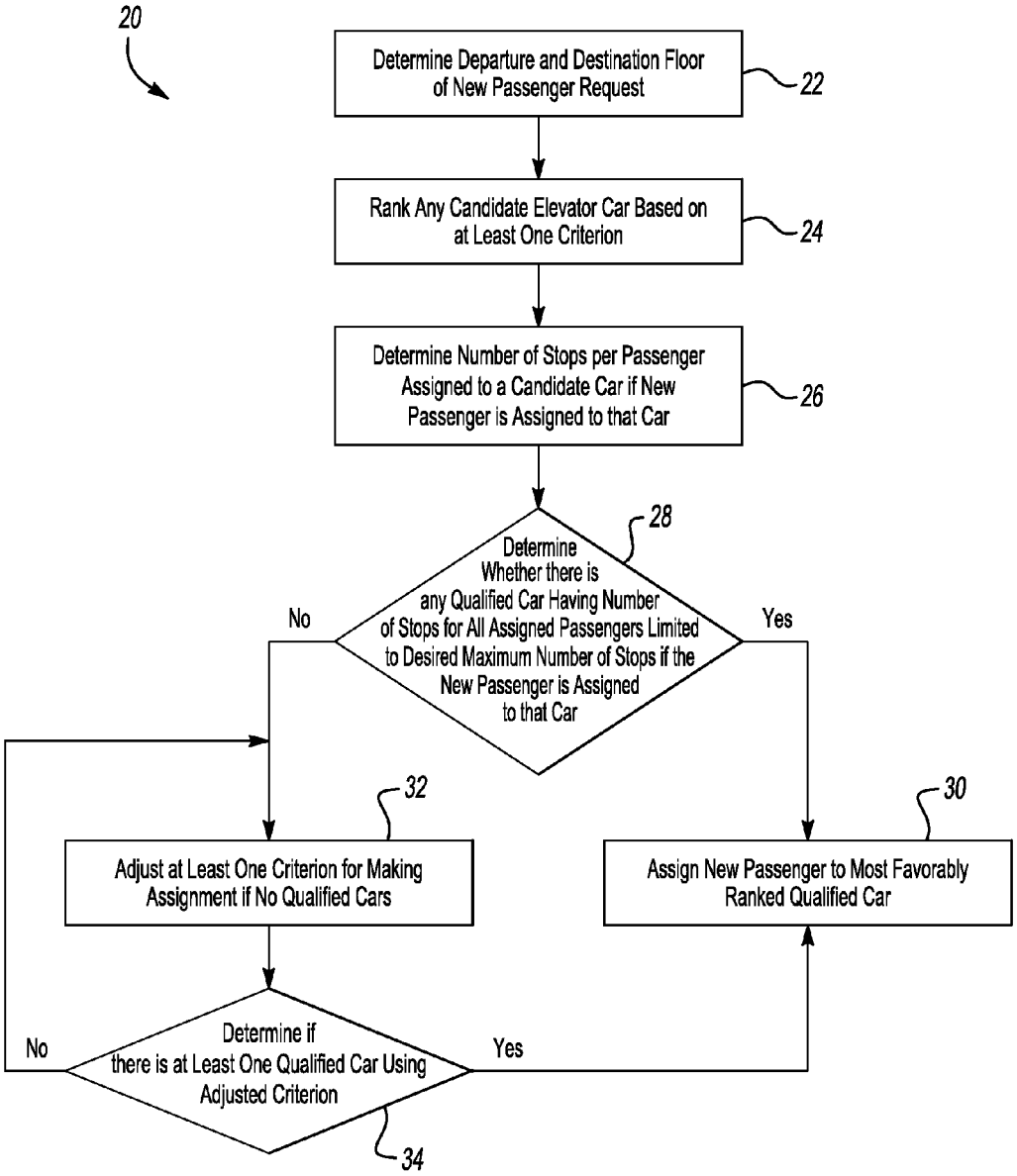
FIG. 1 is a flowchart diagram summarizing an example approach for assigning passenger requests to elevator cars.

FIG. 1 includes a flowchart diagram 20 that summarizes an example approach for controlling an elevator system. The example approach limits a number of stops that each passenger experiences while being carried from a departure floor to an intended destination floor.

The example of FIG. 1 begins at 22 where a determination is made regarding a departure and destination floor of a new passenger request. This is accomplished in some examples using known techniques that allow for an elevator system to determine the destination of a passenger before that passenger boards an elevator car. There are known destination entry systems, for example, that provide such information to an elevator system controller. In some examples, the disclosed techniques for limiting the number of stops experienced by passengers are useful even if a destination entry system is not used by all passengers. In other words, this invention is not necessarily limited to known destination entry systems.

At 24, any candidate elevator car, which may be considered as a potential candidate for carrying the new passenger from the determined departure floor to the determined destination floor, is ranked based on at least one criterion. One example includes ranking any candidate elevator cars based upon a preselected ranking criterion that comprises at least one of a wait time for a passenger to board an elevator car, an in-car time for a passenger, a number of assigned passengers for a car or a current direction of travel of a car, for example. One example includes using a combination of at least two such criteria for purposes of ranking the candidate elevator cars. Any candidate elevator car that has a more favorable status based on the selected criteria is ranked more favorably than another candidate car.

Ranking the candidate elevator cars based upon wait time in one example includes the cars having the shortest wait time for a passenger to board the car being ranked more favorably than other cars where the wait time is longer. In examples where the amount of time in the car is used for ranking purposes, a shorter time within the elevator car for a passenger is considered more favorable than a longer time. When the number of passengers assigned to a car is considered, a less crowded car is more favorable than one that is more fully loaded. Some examples include known techniques for ranking elevator cars.

In one example, the car assignment algorithm includes attempting to minimize the number of stops for as many passengers as possible within the elevator system. That is factored in as one of the criteria for purposes of ranking cars in one example.

At 26, a number of stops for each passenger assigned to a candidate elevator car is determined if the new passenger is assigned to that car. The assigned passengers include any passengers currently on board the elevator car and any passengers waiting to be picked up by that elevator car. Assigned passengers include passengers who have entered a car and used a car operating panel to enter their intended destination. In other words, it is possible to accommodate passengers who do not use a destination entry system within at least some implementations of this invention. When considering the assigned passengers, the disclosed example includes determining whether any of the assigned passengers will depart from the elevator car at a time such that adding the new passenger to that car will not have any impact on such a passenger.

A number of stops for each passenger is limited to a desired maximum number of stops whenever possible. Previous elevator car assignment algorithms did not account for the number of stops experienced by each passenger serviced by a particular elevator car. The disclosed example, therefore, provides enhanced passenger service by controlling the number of stops a passenger experiences between boarding an elevator car and arriving at the intended destination.

At 28, a determination is made whether there is any qualified car that can accept an assignment of the new passenger. A qualified car in this example has the number of stops for all passengers assigned to that car limited to the desired maximum number of stops. A qualified car satisfies the maximum number of stops for all passengers including the new passenger if that passenger is assigned to that car.

The desired maximum number of stops in one example is the same for all passengers and for all cars. In another example, the desired maximum number of stops varies between passengers. At least one of the passengers has a different desired maximum number of stops compared to at least one other passenger. Such an arrangement accommodates VIP or other special considerations to give selected passengers premium service, for example. In such systems, some identification of the passenger is obtained and a corresponding maximum number of stops is accounted for regarding that passenger when making the determination at 28 in the example of FIG. 1.

In another example, different elevator cars may be assigned to particular types of service and, therefore, the maximum number of stops for a passenger in one of those cars is different than the allowable maximum number for passengers in another car. Such an arrangement allows for accommodating up peak or down peak travel and dedicating one or more elevator cars to such specialized service. Other elevator cars may be used in a different manner and, therefore, can accommodate a different number of stops per passenger, for example. Some examples include varying the desired maximum number of stops based upon a time of day when a new passenger request is received. The control algorithm used for making the determination at 28 in the example of FIG. 1 may be time dependent, for example.

Another example includes varying the desired maximum number of stops based upon a floor at which the request is placed, a destination floor or a combination of these. For example, a passenger traveling from a ground level to a destination near the top of a building could be allowed to experience more stops than a passenger traveling a shorter distance within the same building. Given this description, those skilled in the art will be able to select appropriate maximum numbers of stops to accommodate the particular circumstances and configuration of a particular elevator system.

As shown at 30 in FIG. 1, the new passenger is assigned to the most favorably ranked of any qualified cars. In some instances, the most favorably ranked qualified car will not be the most favorably ranked candidate elevator car. For example, one elevator car may be the most favorably ranked based upon wait time for the passenger to board the elevator car. That same elevator car, however, may already have assigned passengers whose number of stops will exceed the desired maximum if the new passenger were assigned to that car. A less favorably ranked candidate elevator car, on the other hand, may be able to accommodate the new passenger without exceeding the desired maximum number of stops for any passenger assigned to that elevator car.

In some instances, the determination at 28 will result in no car being a qualified car. Under such circumstances, an adjustment is made at 32 to at least one criterion for making the assignment. For example, the maximum number of stops for at least one passenger may be increased. In some examples, the number of allowable stops may be increased for all passengers. In other examples that accommodate different status or classes for different passengers, only lower priority passengers may have their number of stops increased, for example. Another example includes making an adjustment at 32 by increasing the allowable number of stops for passengers in at least one of the elevator cars. It is possible, for example, to increase the allowable number of stops for all elevator cars or only selected ones of the elevator cars for purposes of attempting to find a qualified car.

In one example, when there is no qualified car, another criterion such as minimum wait time is used as the deciding factor for purposes of making the car assignment. Other criteria such as the current load in an elevator car, the in car time or another factor is used for purposes of selecting one of the candidate cars for making the assignment of the new passenger request.

As shown at 34, a determination is made whether at least one of the candidate elevator cars qualifies as a qualified car using the adjusted criterion. If not, another adjustment is made at 32 until a qualified car is located to make the assignment at 30.

In one example, every candidate elevator car is considered for purposes of determining whether it is a qualified car. In one such example, the number of stops for every assigned passenger will be determined before making the assignment of the new passenger request to one of the elevator cars. In another example, the highest or most favorably ranked candidate car is considered first. If that car is a qualified car, the assignment of a new passenger is made to that car without considering any other candidate car. In one such example, the candidate cars are considered in order of ranking from most favorable to least favorable until the qualified car is identified and the new passenger is then assigned to that car.

FIG. 2 schematically illustrates an example operating condition of an elevator system 40. For discussion purposes, three elevator cars and a plurality of floor levels are schematically illustrated. A first elevator car, car A, is currently at floor 15 in the position shown at 42. Car A is or will be moving downward. Another elevator car, car B, is in a position shown at 44. Car B is moving downward and is at the floor level 1 in FIG. 2. A third elevator car, car C, is in the position shown at 46. Car C is currently moving upward and passing floor number 10.

An elevator controller 50 utilizes known techniques for purposes of maintaining current status information regarding each of the elevator cars including their current position and direction of travel. The elevator controller 50 is also configured to maintain information regarding the status of passengers assigned to each elevator car. The assigned passengers include passengers on board each car and passengers assigned to be picked up by each car.

A passenger interface 52 allows for a passenger to enter a request for elevator service. Any passenger that is not yet assigned to an elevator car can be considered a new passenger for purposes of discussion. The controller 50 is configured to assign a new passenger to one of the elevator cars using an assignment strategy as illustrated in FIG. 1 and described above.

Assume, for example, that a new passenger enters a request to be carried from the lobby floor to floor number 15. Assume also that the desired maximum number of stops for any passenger in any of the elevator cars is currently set to three. Given the conditions illustrated in FIG. 2, car A will next stop at floor 14 as shown at 54 to pick up an already assigned passenger who desires to be carried to the lobby. Car A will also stop at floor 11 to pick up another already assigned passenger who desires to be carried down to the lobby. This is indicted at 56 in FIG. 2. Another stop that car A will make on its way to the lobby is to pick up another passenger as shown at 58 who is already assigned to car A to be carried to the lobby. Car A will arrive at the lobby as shown at 60 to allow the passengers to exit the elevator car at their intended destination.

Car B is currently at floor one and heading downward to pick up a passenger assigned to be carried from the lobby up to floor 11 as shown at 62. On the way up to floor 11, car B will stop to pick up an assigned passenger on floor three as shown at 64. That passenger intends to be carried to floor number five so car B will make a stop as shown at 66. Car B has also been assigned to pick up a passenger on floor six who desires to be carried up to floor 11 as shown at 68. At 70, car B will arrive at the assigned destination of two passengers where they will exit the car.

Car C is currently going up from the tenth floor to pick up a passenger assigned to that car who desires to be carried from floor 12 down to the lobby as shown at 72. Car C will then proceed down to the assigned destination (i.e., the lobby) as shown at 74.

The elevator controller 50 in this example considers all three of the cars as potential candidate elevator cars for purposes of carrying the new passenger from the lobby to the fifteenth floor. When ranking the candidate elevator cars, car B is ranked the most favorably because it is closest to the lobby and will provide the shortest wait time for the new passenger. For example, car B may be able to receive the new passenger within a few seconds. Additionally, the new passenger will not increase the waiting time of the passengers assigned to car B to be picked up from floor three or floor six because car B is already assigned to pick up a passenger at the lobby as shown at 62. In this example, car C will be ranked second behind car B because it can arrive at the lobby to pick up the new passenger sooner than car A. For purposes of discussion, car C can arrive approximately thirty seconds sooner than car A.

When determining whether there are any qualified cars having the number of stops for all assigned passengers limited to the desired maximum of three stops, only cars A and C are qualified cars. Car B will have to stop at floor three and floor six to answer the calls of the already assigned passengers. Car B will also have to stop at the assigned destination floors five and 11 as shown at 66 and 70. If the new passenger were assigned to car B, that passenger will stop more than three times before arriving at floor 15. Therefore, even though car B was the most favorably ranked of the candidate elevator cars, car B is not a qualified car under these circumstances.

Car A and car C are each a qualified car in this example. No passenger on either of those cars will experience a number of stops beyond the desired limit of three if the new passenger is assigned to that car. In this example, car C is more favorably ranked than car A because it can arrive at the lobby sooner. Therefore, the controller 50 assigns the new passenger to car C.

Consider another example in which a passenger request is received to be carried from the lobby floor to floor number 9. The candidate cars are ranked the same as in the previous example because the departure floor is the lobby as in the previous example and the current status of the system is the same as in the previous example. Considering the most favorably ranked candidate car first, car B can accept an assignment of the new passenger without increasing the waiting time of any passengers assigned to that car. If the new passenger is assigned to car B, however, the passenger already assigned to that car desiring to be carried from the lobby to the eleventh floor will have to stop more than three times and, therefore, car B is not a qualified car. In this example circumstance, car C and car A are both qualified cars. Car C is the more favorably ranked of those two cars. The controller 50 in this example assigns the new passenger request to car C.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of controlling an elevator system, comprising the steps of:

determining that a new passenger requests elevator service from a departure floor to a destination floor;

ranking any candidate elevator cars based on at least one criterion;

determining a number of stops for each assigned passenger for a ranked candidate elevator car if the new passenger is assigned to the ranked candidate elevator car;

determining whether any ranked candidate elevator car is a qualified car that can accept the new passenger and limit a number of stops for each passenger assigned to the qualified car to a desired maximum number of stops; and assigning the new passenger to a qualified car that has a most favorable ranking of any qualified cars.

2. The method of claim 1, wherein none of the ranked candidate elevator cars is a qualified car for a current elevator system condition and the method comprises assigning the new passenger to one of the candidate elevator cars based on at least one different criterion.

3. The method of claim 2, comprising at least temporarily increasing the desired maximum number of stops to a higher maximum for at least one of the passengers;

determining whether any ranked candidate elevator car is a qualified car that can accept the new passenger and limit a number of stops for the at least one of the passengers assigned to the qualified car to the higher maximum number; and assigning the new passenger to a qualified car that has a most favorable ranking of any qualified cars.

4. The method of claim 3, comprising at least one of increasing the desired maximum number of stops for at least one of the passengers differently than at least one other passenger; or increasing the desired maximum number of stops for any passenger assigned to at least one of the elevator cars differently than any passenger assigned to at least one other elevator car.

5. The method of claim 2, wherein the at least one other criterion comprises at least one of a wait time for a passenger to board an elevator car, an in-car time for a passenger, a number of assigned passengers for an elevator car or a current direction of travel of an elevator car.

6. The method of claim 1, comprising using a first desired maximum number of stops for at least one passenger that is different than a second desired maximum number of stops for at least one other passenger.

7. The method of claim 1, comprising selecting the desired maximum number of stops for a selected passenger depending on at least one of a departure floor of the selected passenger, a destination floor of the selected passenger, a time of day when the request is received from the selected passenger, a direction of travel of the selected passenger, or a status or identification of the selected passenger.

8. The method of claim 1, wherein the at least one criterion comprises at least one of a wait time for a passenger to board an elevator car, an in-car time for a passenger, a number of assigned passengers for a car or a current direction of travel of a car.

9. The method of claim 1, comprising at least temporarily increasing the desired maximum number of stops to a higher maximum for at least one of the passengers;

determining whether any ranked candidate elevator car is a qualified car that can accept the new passenger and limit a number of stops for the at least one of the passengers assigned to the qualified car to the higher maximum number; and assigning the new passenger to a qualified car that has a most favorable ranking of any qualified cars.

10. The method of claim 1, comprising minimizing the number of stops for each of the assigned passengers for as many of the candidate elevator cars as possible.

11. An elevator system, comprising:

a plurality of elevator cars; and a controller that is configured to determine that a new passenger requests elevator service from a departure floor to a destination floor;

rank any candidate elevator cars based on at least one criterion;

determine a number of stops for each assigned passenger for a ranked candidate elevator car if the new passenger is assigned to the ranked candidate elevator car;

determine whether any ranked candidate elevator car is a qualified car that can accept the new passenger and limit a number of stops for each passenger assigned to the qualified car to a desired maximum number of stops; and assign the new passenger to a qualified car that has a most favorable ranking of any qualified cars.

12. The elevator system of claim 11, wherein none of the ranked elevator cars is a qualified car for a current elevator system condition and the controller is configured to assign the new passenger to one of the candidate elevator cars based on at least one different criterion.

13. The elevator system of claim 12, wherein the controller is configured to at least temporarily increase the desired maximum number of stops to a higher maximum for at least one of the passengers;

determine whether any ranked candidate elevator car is a qualified car that can accept a new passenger and limit a number of stops for the at least one of the passengers assigned to the qualified car to the higher maximum number; and assign the new passenger to a qualified car that has a most favorable ranking of any qualified cars.

14. The elevator system of claim 13, wherein the controller is configured to increase the desired maximum number of stops for at least one of the passengers differently than at least one other passenger; or increase the desired maximum number of stops for any passenger assigned to at least one of the elevator cars differently than any passenger assigned to at least one other elevator car.

15. The elevator system of claim 12, wherein the at least one other criterion comprises at least one of a wait time for a passenger to board an elevator car, an in-car time for a passenger, a number of assigned passengers for an elevator car, or a current direction of travel of an elevator car.

16. The elevator system of claim 11, wherein the controller is configured to use a first desired maximum number of stops for at least one passenger that is different than a second desired maximum number of stops for at least one other passenger.

17. The elevator system of claim 11, wherein the controller is configured to select the desired maximum number of stops for a selected passenger depending on at least one of a departure floor of the selected passenger, a destination floor of the selected passenger, a time of day when the request is received from the selected passenger, a direction of travel of the selected passenger, or a status of the selected passenger.

18. The elevator system of claim 11, wherein the at least one criterion comprises at least one of a wait time for a passenger to board an elevator car, an in-car time for a passenger, a number of assigned passengers for a car or a current direction of travel of a car.

19. The elevator system of claim 18, wherein the controller is configured to at least temporarily increase the desired maximum number of stops to a higher maximum for at least one of the passengers;

determine whether any ranked candidate elevator car is a qualified car that can accept the new passenger and limit a number of stops for the at least one of the passengers assigned to the qualified car to the higher maximum number; and assign the new passenger to a qualified car that has a most favorable ranking of any qualified cars.

20. The elevator system of claim 11, wherein the controller is configured to minimize the number of stops for each of the assigned passengers for as many of the candidate elevator cars as possible.

* * * * *